US008348644B2

(12) United States Patent
Tsutsumidani

(10) Patent No.: US 8,348,644 B2
(45) Date of Patent: Jan. 8, 2013

(54) HIGH PRESSURE FUEL INJECTOR SUPPLY PUMP

(75) Inventor: Shinya Tsutsumidani, Okazaki (JP)

(73) Assignee: Denso Corporation, Kariya (JP)

( * ) Notice: Subject to any disclaimer, the term of this patent is extended or adjusted under 35 U.S.C. 154(b) by 415 days.

(21) Appl. No.: 12/716,648

(22) Filed: Mar. 3, 2010

(65) Prior Publication Data

US 2010/0226804 A1 Sep. 9, 2010

(30) Foreign Application Priority Data

Mar. 5, 2009 (JP) ..... 2009-51825

(51) Int. Cl.
*F04B 53/10* (2006.01)
*F01B 31/00* (2006.01)

(52) U.S. Cl. ..... 417/571; 92/163; 92/169.1

(58) Field of Classification Search ..... 417/470, 417/571; 92/163, 169.1
See application file for complete search history.

(56) References Cited

U.S. PATENT DOCUMENTS 3,716,310 A * 2/1973 Guenther ..... 417/552
3,862,590 A * 1/1975 Mengeler ..... 92/163
6,168,398 B1 * 1/2001 Handtmann ..... 417/510
6,364,641 B2 4/2002 Mori

FOREIGN PATENT DOCUMENTS

JP 64-073166 3/1989
JP 2009-068371 4/2009

* cited by examiner

*Primary Examiner* — Charles Freay
(74) *Attorney, Agent, or Firm* — Nixon & Vanderhye P.C.

(57) ABSTRACT

A pump includes a cylinder and a plunger. The cylinder defines an outlet-side passage therein. The plunger is reciprocably received within the cylinder. An inner peripheral surface of the cylinder and an end surface of the plunger define a pump chamber. The outlet-side passage is communicated with the pump chamber. When the plunger reciprocates within the cylinder, fluid inside the pump chamber is pressurized such that fluid is discharged to an exterior through the outlet-side passage. The inner peripheral surface includes a spherical surface part that surrounds the pump chamber. The spherical surface part is defined by a curved surface having a predetermined curvature such that the pump chamber defines a spherical space. The spherical surface part is provided with an opening of the outlet-side passage, which has a circular shape when observed from a spherical center of the pump chamber.

10 Claims, 5 Drawing Sheets

HIGH PRESSURE FUEL INJECTOR SUPPLY PUMP

CROSS REFERENCE TO RELATED APPLICATION

This application is based on and incorporates herein by reference Japanese Patent Application No. 2009-51825 filed on Mar. 5, 2009.

BACKGROUND OF THE INVENTION

1. Field of the Invention

The present invention relates to a pump that suctions and discharges fluid.

2. Description of Related Art

A fuel injection apparatus, which injects fuel to a compression ignition internal combustion engine, has a supply pump that compresses fuel and supplies the compressed fuel to a common rail. The supply pump has a hollow-cylindrical compression space (hereinafter, referred as a pump chamber) formed by an inner peripheral surface of a cylinder and an end surface (top portion) of a plunger. When the plunger reciprocates within the cylinder to pressurize fuel in the pump chamber, high pressure fuel is discharged toward the common rail through a discharge passage (for example, JP-A-S64-73166). For example, the discharge passage has an opening that is formed at an inner peripheral surface of the cylinder, which surface surrounds the pump chamber.

In the conventional supply pump, when fuel within the pump chamber is compressed, fuel pressure disadvantageously causes localized stress concentration generated around the opening formed at the inner peripheral surface of the cylinder.

Generation of the stress concentration at the opening formed at the inner peripheral surface of the cylinder will be described with reference to FIGS. 7A and 7B. FIG. 7A is a cross-sectional view of a part of a cylinder of the conventional supply pump, and FIG. 7B is a partial development for developing the vicinity of the opening of the cylinder inner peripheral surface in a circumferential direction along the inner peripheral surface of the cylinder of the conventional supply pump. It should be noted that multiple arrows in FIG. 7B indicate directions of tensile stress generated when fuel within the pump chamber is compressed.

The conventional supply pump, as shown in FIG. 7B, has an opening 130*b*. For example, the opening 130*b* has an oval shape and is formed at a cylinder inner peripheral surface 130*a* of a cylinder 130, which surface surrounds a pump chamber 150. The cylinder inner peripheral surface 130*a* intersects or is connected with an inner peripheral surface of a discharge passage 130*c* at the opening 130*b* as shown in FIG. 7A. When fuel in a pump chamber 150 is pressurized, fuel pressure expands the cylinder inner peripheral surface 130*a*, which surrounds the pump chamber 150, in a radially outward direction of the cylinder 130. Further, the discharge passage 130*c* is also expanded in a radially outward direction of the discharge passage 130*c*. As a result, an outline of the opening 130*b* formed at the cylinder inner peripheral surface 130*a* deforms from an oval shape (solid line in FIG. 7B) into a more circular shape (alternate long and short dash line in FIG. 7B).

In the above, tensile stress is applied to the cylinder inner peripheral surface 130*a* in a circumferential direction of the cylinder 130 along the cylinder inner peripheral surface 130*a*. Also, tensile stress is applied to the vicinity of the opening 130*b*, which has the oval shape, and which is formed at the cylinder inner peripheral surface 130*a*, in the circumferential direction of the discharge passage 130*c* along the opening 130*b*.

In the above, tensile stress applied to the vicinity of the opening 130*b* is large at positions X (indicated by dashed line) and is small at positions Y (indicated by dashed line), and thereby distribution of tensile stress applied to the vicinity of the opening 130*b* is ununiform. As a result, localized stress concentration is more likely to be generated at the opening 130*b* of the cylinder inner peripheral surface 130*a*. Thus, repetition of suctioning and discharging fuel during the operation of the pump may cause fluctuation of stress at the vicinity of the opening 130*b*, and thereby fatigue failure may be caused disadvantageously. Subsequently, the cylinder may be broken.

SUMMARY OF THE INVENTION

The present invention is made in view of the above disadvantages. Thus, it is an objective of the present invention to address at least one of the above disadvantages.

To achieve the objective of the present invention, there is provided a pump that includes a cylinder and a plunger. The cylinder has an inner peripheral surface, wherein the cylinder defines an outlet-side passage therein. The plunger is reciprocably received within the cylinder. The plunger has an end surface. The inner peripheral surface of the cylinder and the end surface of the plunger define a pump chamber. The outlet-side passage of the cylinder is communicated with the pump chamber. When the plunger reciprocates within the cylinder, fluid inside the pump chamber is pressurized such that fluid is discharged to an exterior of the pump through the outlet-side passage. The inner peripheral surface of the cylinder includes a spherical surface part that surrounds the pump chamber. The spherical surface part is defined by a curved surface having a predetermined curvature such that the pump chamber defines a spherical space. The spherical surface part is provided with an opening of the outlet-side passage. The opening of the outlet-side passage has a circular shape when observed from a spherical center of the pump chamber.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS (First Embodiment)

The first embodiment of the present invention will be described below with reference to FIG. 1 to FIG. 3. A pump of the present embodiment serves as a supply pump in a fuel injection apparatus, which injects fuel to a compression ignition internal combustion engine, and the pump supplies high-pressure fuel to a common rail that accumulates high-pressure fuel therein.

Figure 1:
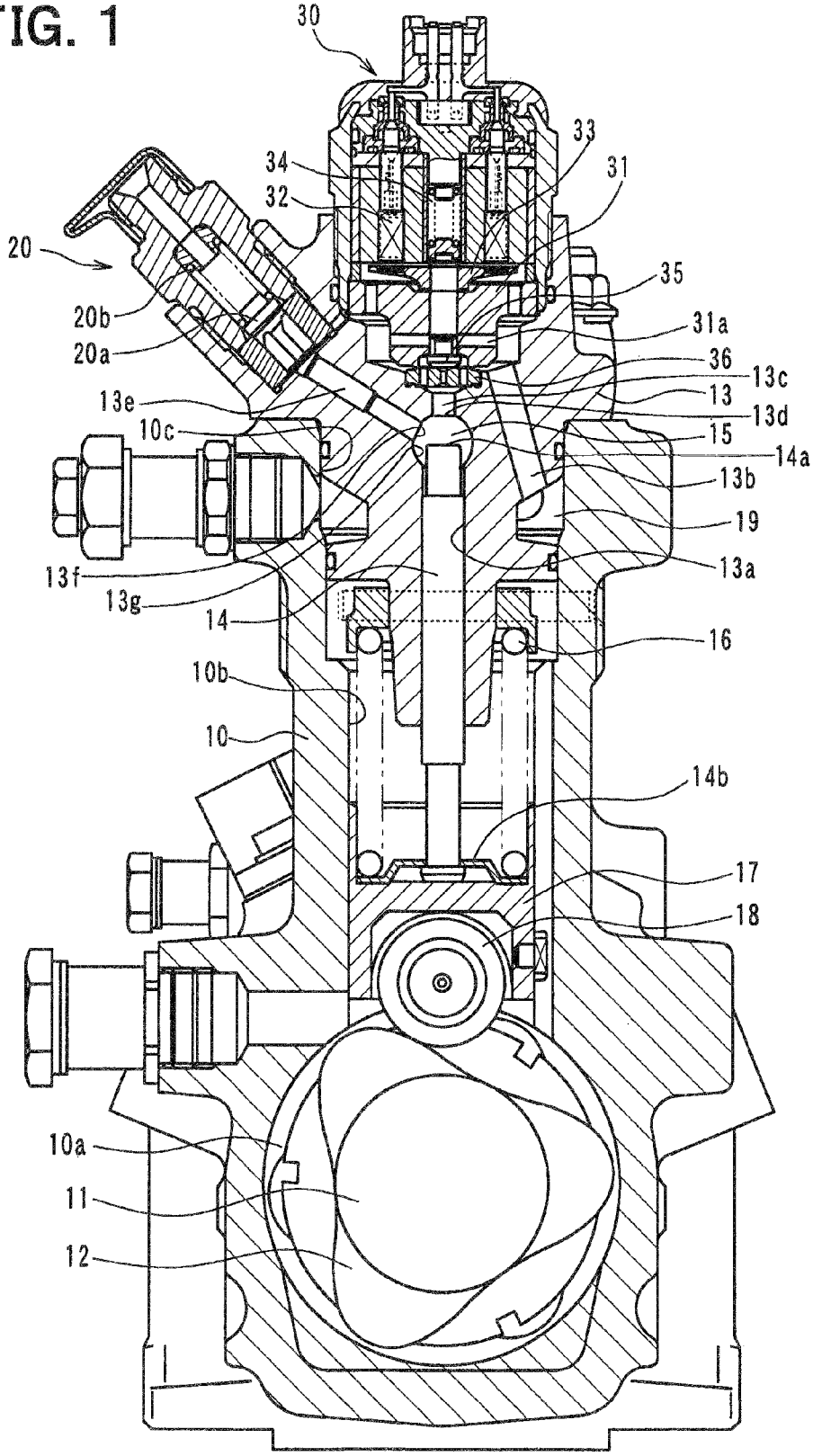
FIG. 1 is a cross-sectional view illustrating a configuration of a pump according to the first embodiment of the present invention.

FIG. 1 shows a configuration of the pump of the present embodiment, and a pump housing 10 has a cam chamber 10*a*, a slide body receiving hole 10*b*, and a cylinder receiving hole 10*c*. The cam chamber 10*a* is located at a lower end side of the pump housing 10, and the slide body receiving hole 10*b* has a cylindrical shape that extends from the cam chamber 10*a* upwardly in a longitudinal direction of the pump housing 10. The cylinder receiving hole 10*c* has a cylindrical shape that extends from the slide body receiving hole 10*b* to an top end surface of the pump housing 10.

The cam chamber 10*a* is provided with a camshaft 11 that is driven by a compression ignition internal combustion engine (hereinafter, referred as the internal combustion engine), which is not shown. The camshaft 11 is rotatably supported by the pump housing 10. Also, the camshaft 11 has a cam 12.

The cylinder receiving hole 10*c* is attached with a cylinder 13 such that the cylinder 13 closes the cylinder receiving hole 10*c*. The cylinder 13 includes a cylindrical plunger receiving hole part 13*a* that reciprocably receives therein a cylindrical plunger 14. A top end surface 14*a* of the plunger 14 and an inner peripheral surface of the cylinder 13 defines a pump chamber 15. The details of the pump chamber 15 will be described later.

A seat 14*b* is connected to a lower end of the plunger 14, and the seat 14*b* is pressed against a slide body 17 by a spring 16. The slide body 17 has a hollow cylindrical shape, and is reciprocably received by the slide body receiving hole 10*b*. Also, the slide body 17 is attached with a cam roller 18 that is rotatable, and the cam roller 18 contacts the cam 12. When the cam 12 rotates in accordance with the rotation of the camshaft 11, the plunger 14 is reciprocably actuated together with the seat 14b, the slide body 17, and the cam roller 18.

The cylinder 13 and the pump housing 10 defines therebetween a fuel receiver 19. The fuel receiver 19 is supplied with low-pressure fuel that is discharged from a feed pump (not shown) through a low-pressure fuel pipe (not shown).

Also, the fuel receiver 19 is communicated with the pump chamber 15 through an intake passage 13*b*, an intake passage 31*a*, and an inlet-side passage 13*c*. The intake passage 13*b* is provided to the cylinder 13, and the intake passage 31*a* is provided within a solenoid valve 30. The inlet-side passage 13*c* has an opening 13*d* at the inner peripheral surface of the cylinder 13, which surface surrounds the pump chamber 15, such that the inlet-side passage 13*c* is communicated with the pump chamber 15. It should be noted that the inlet-side passage 13*c* is formed at the cylinder 13, and has a cross section of a circular shape when taken along a plane perpendicular to a flow direction of fuel. For example, the flow direction of fuel corresponds to an axial direction of the inlet-side passage 13*c*.

The inner peripheral surface of the cylinder 13, which surface surrounds the pump chamber 15, is provided with an opening 13*f* of an outlet-side passage 13*e* that is always communicated with the pump chamber 15. It should be noted that the outlet-side passage 13*e* is formed at the cylinder 13, and has a cross section of a circular shape when taken along a plane perpendicular to a flow direction of fuel. For example, the flow direction of fuel corresponds to an axial direction of the outlet-side passage 13*e*. The pump chamber 15 is connected to a common rail (not shown) through the outlet-side passage 13*e*, a discharge valve 20, and a high pressure fuel piping (not shown).

The discharge valve 20 is provided to the cylinder 13 at a position downstream of the outlet-side passage 13*e*. The discharge valve 20 includes a valve element 20*a* and a spring 20*b*. The valve element 20*a* opens and closes the outlet-side passage 13*e*, and the spring 20*b* urges the valve element 20*a* in a direction for closing the outlet-side passage 13*e*. Fuel pressurized in the pump chamber 15 displaces the valve element 20*a* against biasing force of the spring 20*b* in a direction for opening the outlet-side passage 13*e* such that fuel is pumped to the common rail.

The solenoid valve 30 is threadably fixed to the cylinder 13 at a position to be opposed to the top end surface 14*a* of the plunger 14 such that the solenoid valve 30 closes the pump chamber 15. A body 31 of the solenoid valve 30 defines therein the intake passage 31*a* and a seat portion (not shown). The intake passage 31*a* has one end communicated with the inlet-side passage 13*c* and has the other end communicated with the intake passage 13*b*, and the seat portion is formed within the intake passage 31*a*.

Also, the solenoid valve 30 includes a solenoid 32, an armature 33, a spring 34, a valve element 35, and a stopper 36. The solenoid 32 generates attractive force when energized and attracts the armature 33. The spring 34 urges the armature 33 in a direction away from a direction of the attractive force by the solenoid 32. The valve element 35 opens and closes the intake passage 31*a* when the valve element 35 is displaced together with the armature 33 to be engaged with and disengaged from the seat portion. The stopper 36 regulates a position of the valve element 35, at which position the valve element 35 opens the intake passage 31*a*. The stopper 36 is interposed between the solenoid valve 30 and the cylinder 13 and has multiple communication holes (not shown) that provide communication between the intake passage 31*a* and the pump chamber 15.

Next, a configuration of a part of the pump of the present embodiment will be described with reference to FIG. 2. FIG. 2 is a cross-sectional view illustrating a part of the cylinder of the pump of FIG. 1.

Figure 2:
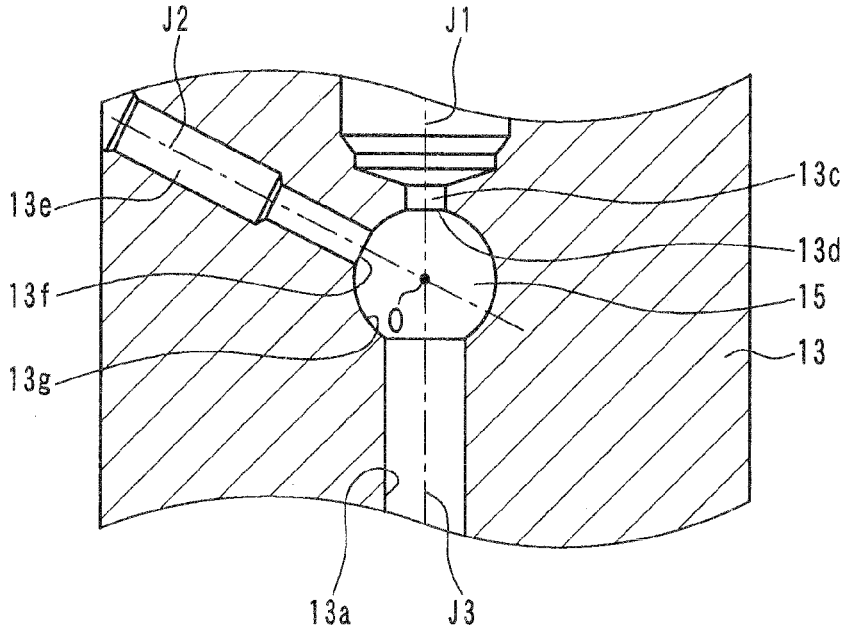
FIG. 2 is cross-sectional view illustrating a part of a cylinder of the pump of FIG. 1.

As shown in FIG. 2, the inner periphery of the cylinder 13, which inner periphery surrounds the pump chamber 15, includes a spherical surface part 13*g*. For example, the spherical surface part 13*g* is defined by a curved surface having a predetermined curvature such that the pump chamber 15 has a spherical space. In other words, the spherical surface part 13*g* is formed at the inner periphery of the cylinder 13, which inner periphery surrounds the pump chamber 15, such that a distance measured in any direction between (a) the spherical surface part 13*g* and (b) a central part (or a spherical center) of a space within the pump chamber 15 is constant.

The spherical surface part 13*g* is formed on one side of the cylindrical plunger receiving hole part 13*a* of the cylinder 13 adjacent the solenoid valve 30, and is formed continuously with the plunger receiving hole part 13*a* and is integral with the plunger receiving hole part 13*a*. In other words, the spherical surface part 13*g* is an integral part of the cylinder 13 such that the spherical surface part 13*g* and the plunger receiving hole part 13*a* are not dividable at the boundary therebetween. Also, the spherical surface part 13*g* has a diameter greater than a diameter of the plunger receiving hole part 13*a*, and an internal space defined by the pump chamber 15 has a spherical shape that is equal to or more than a hemispherical shape.

The spherical surface part 13*g* is provided with the opening 13*d* of the inlet-side passage 13*c* and with the opening 13*f* of the outlet-side passage 13*e*, and each of the openings 13*d*, 13*f* has an outline of a circular shape when observed from a spherical center O of the pump chamber 15.

Also, the inlet-side passage 13*c* is provided such that the spherical center O of the pump chamber 15 is positioned on an extension of a center line J1 (center axial line) of the inlet-side passage 13*c*. In other words, the inlet-side passage 13*c* is formed such that the center line J1 of the inlet-side passage 13*c* corresponds to a normal line that is perpendicular to a plane of the opening 13*d* of the inlet-side passage 13*c* formed at the spherical surface part 13*g*.

Similarly, the outlet-side passage 13*e* is provided such that the spherical center O of the pump chamber 15 is positioned on an extension of a center line J2 (center axial line) of the outlet-side passage 13*e*. In other words, the outlet-side passage 13*e* is provided such that the center line J2 of the outlet-side passage 13*e* corresponds to a normal line that is perpendicular to a plane of the opening 13*f* of the outlet-side passage 13*e* formed at the spherical surface part 13*g*.

As a result, an inner peripheral surface of the inlet-side passage 13*c* is orthogonal to the plane of the opening 13*d* formed at the spherical surface part 13g, and an inner peripheral surface of the outlet-side passage 13*e* is orthogonal to the plane of the opening 13*f* formed at the spherical surface part 13*g*.

The inlet-side passage 13*c* of the present embodiment is formed such that the center line J1 of the inlet-side passage 13*c* is positioned on a straight line that is identical with a center line J3 of the plunger receiving hole part 13*a*. Also, the outlet-side passage 13*e* is formed such that an inferior angle formed between (a) the center line J2 of the outlet-side passage 13*e* and (b) the extension of the center line J3 of the plunger receiving hole part 13*a* (or the center line J1 of the inlet-side passage 13*c*) is an acute angle. It should be noted that the center line J1, J2 of each of the passages 13*c*, 13*e* is parallel with flow direction of fluid within each of the passages 13*c*, 13*e*, respectively, and is a straight line that extends through a center of a cross section of each of the passages 13*c*, 13*e* taken by a plane perpendicularly to the flow direction of fluid. For example, the center line J1, J2 of each of the passages 13*c*, 13*e* extends through a radial center of each of the passages 13*c*, 13*e*.

Next, operation of the above pump will be described. Firstly, when the solenoid 32 of the solenoid valve 30 is not energized, the valve element 35 is located at an opening position by biasing force of the spring 34. In other words, the valve element 35 is spaced apart from the seat portion of the body 31 such that the intake passage 31*a* is opened.

When the plunger 14 moves downwardly or moves way from the pump chamber 15 while the intake passage 31*a* is opened, low-pressure fuel discharged from the feed pump is supplied to the pump chamber 15 through the fuel receiver 19, the intake passage 13*b*, the intake passage 31*a*, and the inlet-side passage 13*c*.

Then, when the plunger 14 starts moving upwardly or moves toward the pump chamber 15, the plunger 14 is displaced in a direction to pressurize fuel in the pump chamber 15. At the earlier stage of the upward movement of the plunger 14, the solenoid valve 30 has not yet been energized, and thereby the intake passage 31*a* has been opened. As a result, fuel in the pump chamber 15 overflows to the fuel receiver 19 through the inlet-side passage 13*c*, the intake passage 31*a*, and the intake passage 13*b*, and thereby is not pressurized.

When the solenoid valve 30 is energized while fuel in the pump chamber 15 overflows to the fuel receiver 19, the armature 33 and the valve element 35 are attracted by the solenoid 32 against the spring 34. As a result, the valve element 35 is engaged with the seat portion of the body 31 to close the intake passage 31*a*. Thus, overflow of fuel toward the fuel receiver 19 is stopped, and thereby compression of fuel in the pump chamber 15 by the plunger 14 is started. Then, pressure of fuel in the pump chamber 15 opens the discharge valve 20 such that fuel is pumped to the common rail through the outlet-side passage 13*e*.

Next, tensile stress applied to the inner peripheral surface of the cylinder 13 while the plunger 14 compresses fuel in the pump chamber 15 will be described with reference to FIG. 3. FIG. 3 is an explanatory diagram for explaining the tensile stress applied to the opening formed at the inner peripheral surface of the cylinder 13. It should be noted that because the above tensile stress is similarly applied to vicinity of the opening 13*d*, 13*f* of each of the passages 13*c*, 13*e*, tensile stress applied to the vicinity of the opening 13*f* of the outlet-side passage 13*e* will be mainly described in the present embodiment. Thus, the description of the tensile stress applied to the vicinity of the opening 13*d* of the inlet-side passage 13*c* will be omitted.

Figure 3:
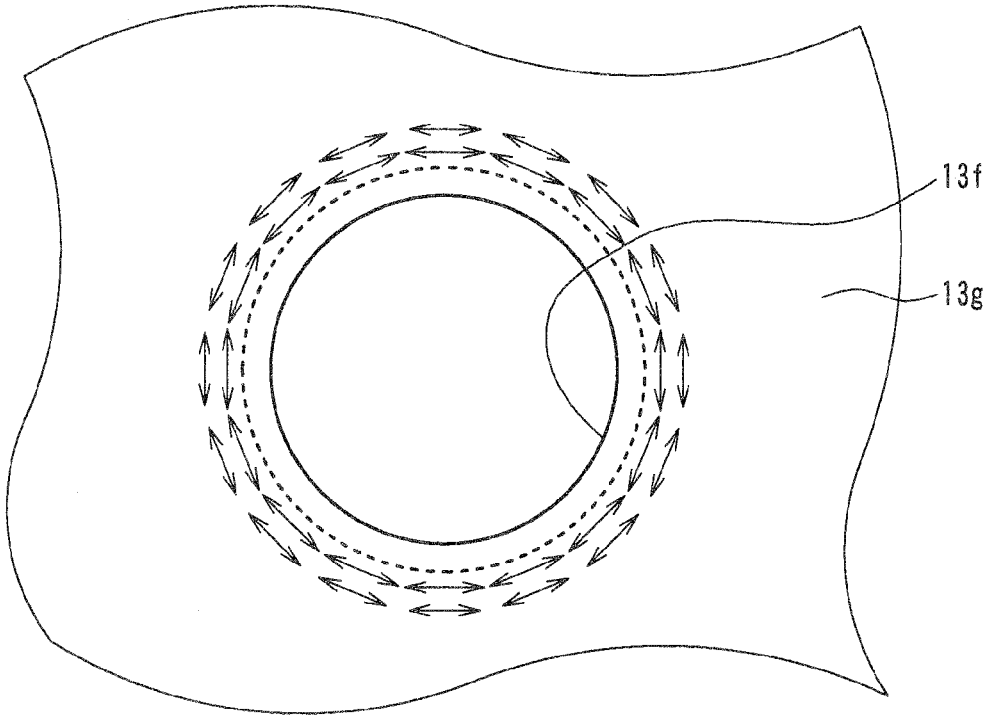
FIG. 3 is an explanatory diagram for explaining tensile stress applied to an opening formed at a cylinder inner peripheral surface.

FIG. 3 shows distribution of tensile stress when the opening 13*f* of the outlet-side passage 13*e* is observed from the spherical center O of the pump chamber 15. Each arrow in FIG. 3 indicates a direction, in which tensile stress is applied to the opening 13*f* of the outlet-side passage 13*e*.

In the supply pump of the present embodiment, when fuel in the pump chamber 15 is pressurized, fuel pressure is uniformly applied to the spherical surface part 13*g* of the cylinder 13, which surrounds the pump chamber 15. As a result, the spherical surface part 13*g* of the cylinder 13, which surrounds the pump chamber 15, is expanded in a radially outward direction of the spherical surface part 13*g*. In other words, the spherical surface part 13*g* is expanded in a normal direction perpendicular to the surface of the spherical surface part 13*g*.

Then, as shown in FIG. 3, the opening 13*f* of the outlet-side passage 13*e* formed at the spherical surface part 13*g* is expanded in a radially outward direction of the opening 13*f* while the shape of the opening 13*f* remains the circular shape. Also, an inner peripheral surface of the outlet-side passage 13*e* is expanded in the radially outward direction of the outlet-side passage 13*e*. It should be noted that a solid line in FIG. 3 indicates the outline of the opening 13*f* before the opening 13*f* is expanded (or before fuel in the pump chamber 15 is compressed). A dashed line in FIG. 3 indicates the outline of the opening 13*f* that has been expanded (or while fuel in the pump chamber 15 is compressed).

With the promotion of the expansion of the opening 13*f* of the outlet-side passage 13*e*, more tensile stress is applied to the opening 13*f* of the spherical surface part 13*g* in a circumferential direction of the opening 13*f* along the outline of the opening 13*f* as shown in FIG. 3. Because the opening 13*f* of the present embodiment expands while the circular shape is maintained as described above, tensile stress, which is applied to at the spherical surface part 13*g* in the vicinity of the opening 13*f*, is uniform in the circumferential direction along the opening 13*f*.

As a result, because distribution of tensile stress applied to the spherical surface part 13*g* in the vicinity of the opening 13*f* is unified, generation of stress concentration to the spherical surface part 13*g* in the vicinity of the opening 13*f* is effectively reduced. As a result, the cylinder 13 is effectively limited from being broken. It should be noted that in the present embodiment, the opening 13*f* of the outlet-side passage 13*e* and the opening 13*d* of the inlet-side passage 13*c* have similar configurations. Thus, the similar advantages are achievable for the opening 13*d* of the inlet-side passage 13*c*.

Also, in the present embodiment, because the spherical surface part 13*g* is continued with and integral with the plunger receiving hole part 13*a*, pressure resistance at the connection between the spherical surface part 13*g* and the plunger receiving hole part 13*a* is reliably achievable.

Furthermore, in the present embodiment, because the spherical surface part 13*g* is formed such that the space of the pump chamber 15 is define to have the spherical shape that is more than the hemisphere shape, it is possible to provide a substantially large area of the spherical surface part 13g, at which the openings 13*d*, 13*f* of the inlet-side passage 13*c* and the outlet-side passage 13*e* are formed. As a result, flexibility of formation positions of the openings 13*d*, 13*f* formed at the spherical surface part 13*g* is effectively enhanced. For example, it is possible to form the openings 13*d*, 13*f* at positions in consideration of pressure drop of fuel in the pump chamber 15.

In an example case, where the spherical center O of the pump chamber 15 is not positioned on the extension of each of the center lines J1, J2 of the passages 13*c*, 13*e*, the angle formed between (a) the inner peripheral surface of each of the passages 13*c*, 13*e* and (b) the plane of each of the openings 13*d*, 13*f* formed at the spherical surface part 13*g* is the acute angle at one side of the opening 13*d*, 13*f* and is an obtuse angle at the other side of the opening 13*d*, 13*f*. As a result, the wall thickness of the cylinder 13 on the one side of the opening 13*d*, 13*f* becomes thinner than the wall thickness on the other side of the opening 13*d*, 13*f*, and thereby higher stress tends to be generated on the one side of the opening 13*d*, 13*f* that has the thinner wall.

In the present embodiment, the inlet-side passage 13*c* and the outlet-side passage 13*e* are formed such that the spherical center O of the pump chamber 15 is positioned on the extension of the center line J1, J2 of each of the passages 13*c*, 13*e* and such that the inner peripheral surface of each of the passages 13*c*, 13*e* is orthogonal to the spherical surface part 13*g*. As a result, because it is possible to uniform the wall thickness in the vicinity of the opening 13*d*, 13*f* of the spherical surface part 13*g*, which thickness is measured in the direction perpendicular to the wall surface, the generation of stress concentration at the vicinity of each of the openings 13*d*, 13*f* is effectively suppressed.

(Second Embodiment)

Figure 4:
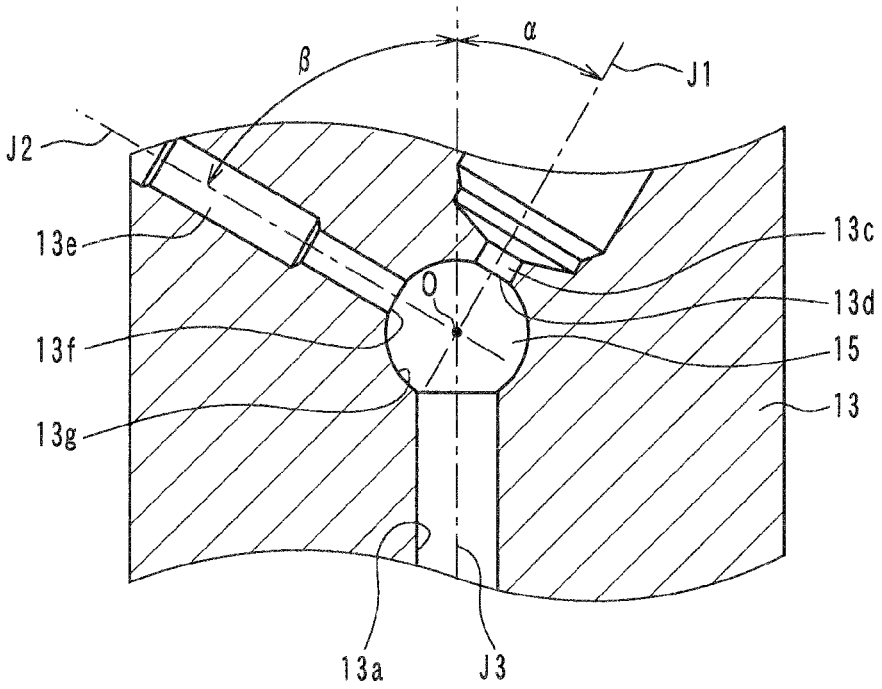
FIG. 4 is a cross-sectional view illustrating a part of a cylinder of a pump according to the second embodiment of the present invention.

Next, the second embodiment of the present invention will be described with reference to FIG. 4. FIG. 4 is a cross-sectional view illustrating a part of a cylinder of the pump of the present embodiment. It should be noted that similar components of the present embodiment, which are similar to the components of the first embodiment, will be designated by the same numerals, and the explanation thereof will be omitted.

In the present embodiment, configurations of the inlet-side passage 13*c* and the outlet-side passage 13*e* formed at the cylinder 13 are different from those in the first embodiment.

As shown in FIG. 4, the inlet-side passage 13*c* of the present embodiment is formed such that an inferior angle α formed between (a) the center line J1 of the inlet-side passage 13*c* and (b) the center line J3 of the plunger receiving hole part 13*a* is about 30 degree. Also, the inlet-side passage 13*c* is formed such that the center line J1 of the inlet-side passage 13*c* intersects the center line J3 of the plunger receiving hole part 13*a*. Also, the outlet-side passage 13*e* is formed such that an inferior angle 3 formed between (a) the center line J2 of the outlet-side passage 13*e* and (b) the center line J3 of the plunger receiving hole part 13*a* is about 60 degree.

The inlet-side passage 13*c* and the outlet-side passage 13*e* are formed such that an inferior angle (α+β) formed between the center line J1 of the inlet-side passage 13*c* and the center line J2 of the outlet-side passage 13*e* is about 90 degree. In other words, the inlet-side passage 13*c* and the outlet-side passage 13*e* are formed such that the center line J1 of the inlet-side passage 13*c* is orthogonal to the center line J2 of the outlet-side passage 13*e*.

In the first embodiment, the inferior angle formed between the center line J1 of the inlet-side passage 13*c* and the center line J2 of the outlet-side passage 13*e* is the acute angle.

However, in the present embodiment, due to the above configuration, the opening 13*d* of the inlet-side passage 13*c* and the opening 13*f* of the outlet-side passage 13*e* are located in the spherical surface part 13*g* at positions that are more separate from each other compared with the case of the first embodiment.

Thus, it is possible to effectively limit the tensile stress, which is applied to one of the openings, from influencing the other tensile stress, which is applied to the other one of the openings. As a result, distribution of tensile stress applied to the vicinity of each of the openings 13*d*, 13*f* is more appropriately uniformed.

(Third Embodiment)

Figure 5:
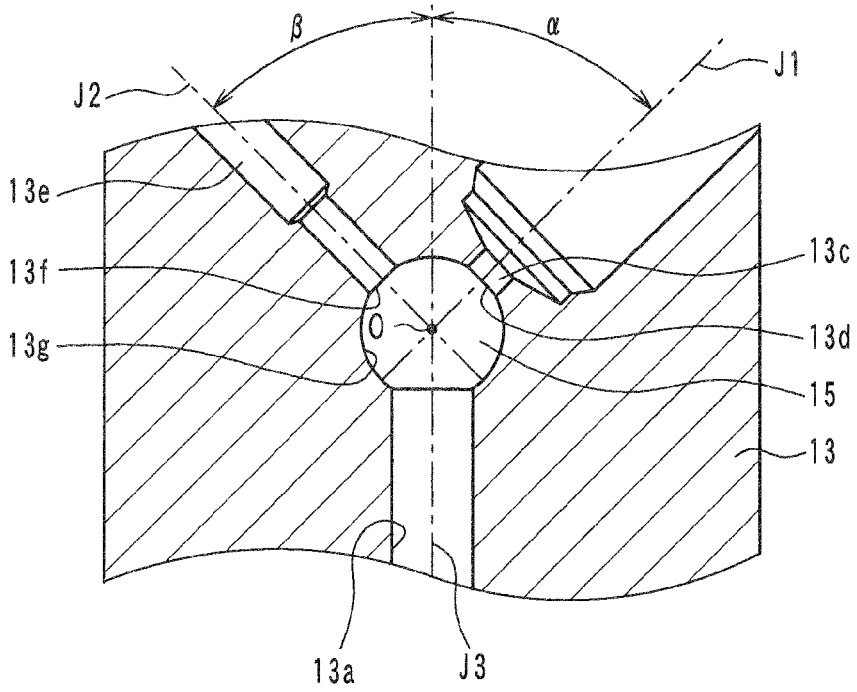
FIG. 5 is a cross-sectional view illustrating a part of a cylinder of a pump according to the third embodiment of the present invention.

Next, the third embodiment of the present invention will be described with reference to FIG. 5. FIG. 5 is a cross-sectional view illustrating a part of a cylinder of the pump of the present embodiment. It should be noted that similar components of the present embodiment, which are similar to the components of the first and second embodiments, will be designated by the same numerals, and the explanation thereof will be omitted.

The present embodiment, the angle formed between (a) the center line J1, J2 of the inlet-side passage 13*c* and the outlet-side passage 13*e* formed at the cylinder 13 and (b) the plunger receiving hole part 13*a* is different from the angle in the second embodiment.

As shown in FIG. 5, the inlet-side passage 13*c* of the present embodiment is formed such that an inferior angle α formed between the center line J1 of the inlet-side passage 13*c* and the center line J3 of the plunger receiving hole part 13*a* is about 45 degree. Also, the outlet-side passage 13*e* is formed such that an inferior angle β formed between the center line J2 of the outlet-side passage 13*e* and the center line J3 of the plunger receiving hole part 13*a* is about 45 degree.

In other words, in the present embodiment, the inferior angle α formed between the center line J1 of the inlet-side passage 13*c* and the center line J3 of the plunger receiving hole part 13*a* is equal to the inferior angle β formed between the center line J2 of the outlet-side passage 13*e* and the center line J3 of the plunger receiving hole part 13*a*.

The inlet-side passage 13*c* and the outlet-side passage 13*e* are formed such that an inferior angle (α+β) formed between the center line J1 of the inlet-side passage 13*c* and the center line J2 of the outlet-side passage 13*e* is about 90 degree.

Due to the above, it is possible to form the opening 13*d* of the inlet-side passage 13*c* at a position on the spherical surface part 13*g* separate from the position of the opening 13*f* of the outlet-side passage 13*e*. As a result, advantages similar to the advantages of the second embodiment is achievable in the present embodiment.

(Fourth Embodiment)

Figure 6:
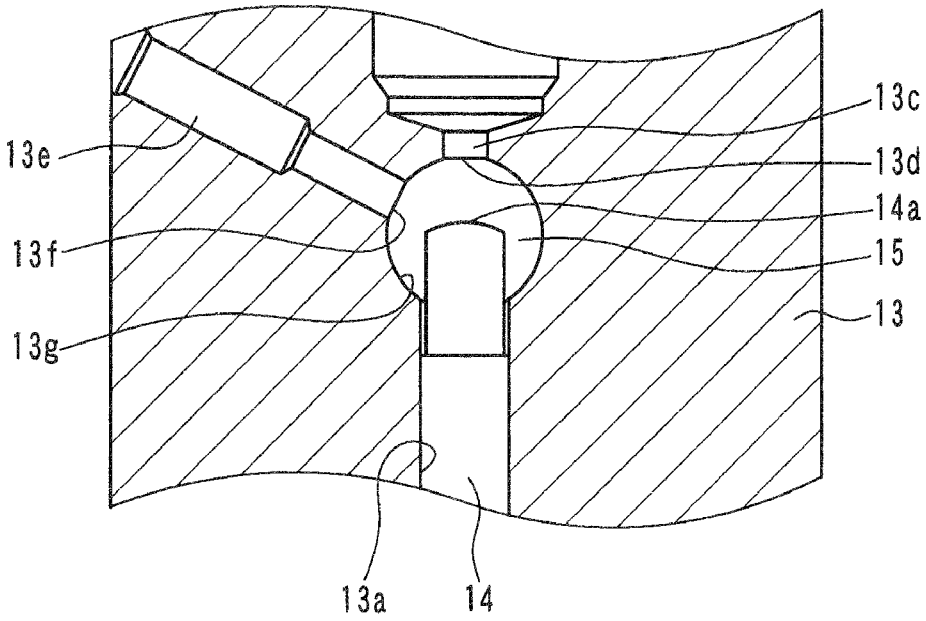
FIG. 6 is a cross-sectional view illustrating a part of a cylinder and a plunger of a pump according to the fourth embodiment of the present invention.
Figure 7A:
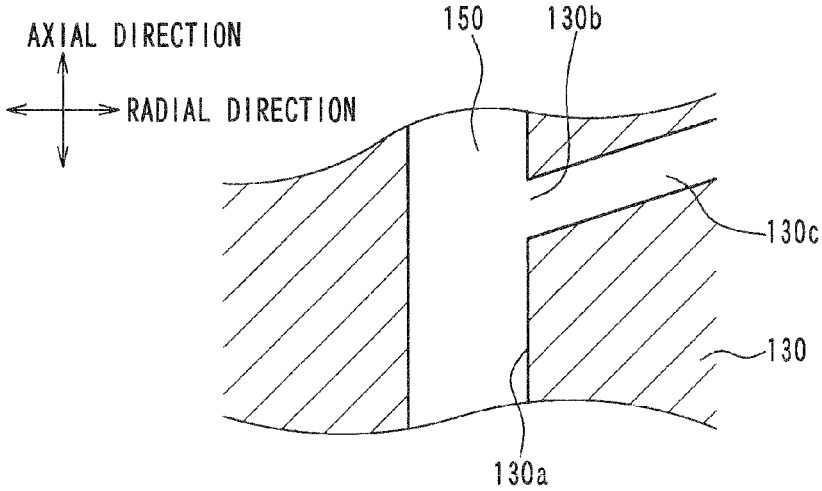
FIG. 7A PRIOR ART
FIG. 7A is an explanatory diagram for explaining a cylinder of a conventional supply pump.
Figure 7B:
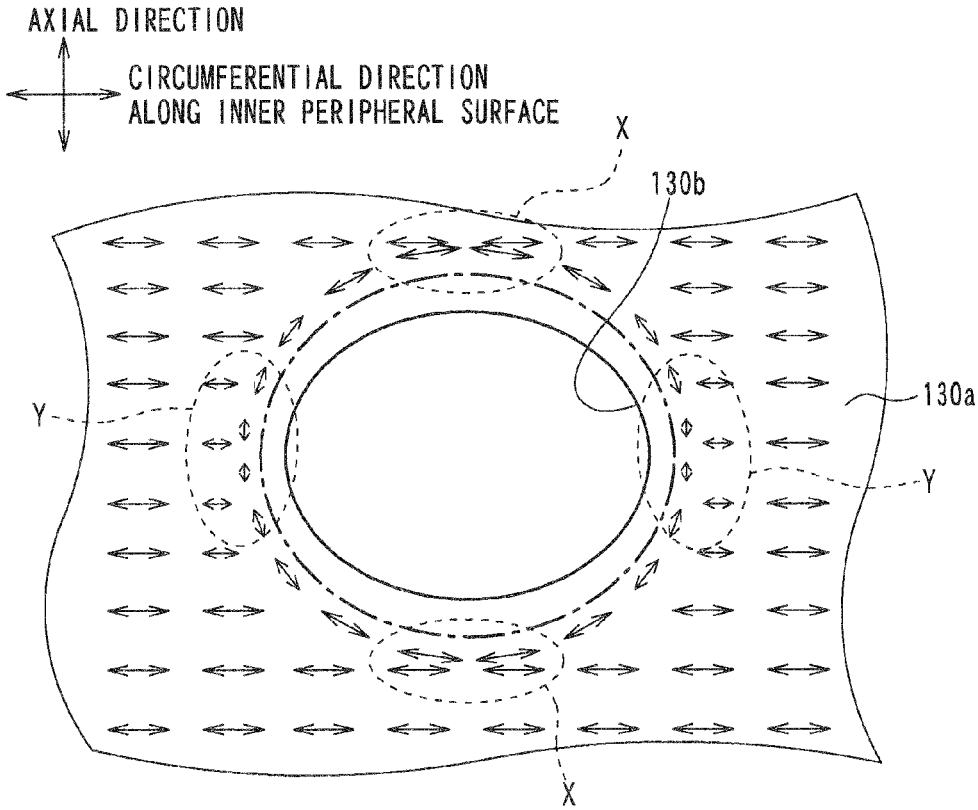
FIG. 7B PRIOR ART
FIG. 7B is another explanatory diagram for explaining a cylinder of a conventional supply pump.

Next, the fourth embodiment of the present invention will be described with reference to FIG. 6. FIG. 6 is a cross-sectional view illustrating a part of a cylinder of the pump of the present embodiment. It should be noted that similar components of the present embodiment, which are similar to the components of the first embodiment, will be designated by the same numerals, and the explanation thereof will be omitted.

In the present embodiment, the shape of the top end surface 14*a* of the plunger 14 is different from the shape in the first embodiment. In the first embodiment, the top end surface 14*a* of the plunger 14 has the flat surface (see FIG. 1). However, in the present embodiment, the top end surface 14*a* of the plunger 14 has a curved surface.

As shown in FIG. 6, the top end surface 14*a* of the plunger 14 of the present embodiment has a shape that corresponds to a shape of the spherical surface part 13*g* of the cylinder 13, which part 13*g* is opposed to the top end surface 14*a*. In other words, the top end surface 14*a* of the plunger 14 is formed into a curved surface having a curvature such that the top end surface 14*a* matches the opposed curved surface of the spherical surface part 13*g*.

Due to the above, it is possible to reduce a dead volume within the pump chamber 15 generated while the plunger 14 is reciprocated in the cylinder 13. The dead volume within the pump chamber 15 indicates an amount of a space that is computed by subtracting (a) an amount of a space in the pump chamber 15 occupied by the plunger 14 when the plunger 14 is positioned at a top dead center from (b) a total amount of a space within the pump chamber 15.

(Other Embodiment)

The present invention is not limited to the above embodiments of the present invention described as above. Provided that the invention does not deviate from the range defined in claims, the invention is not limited to the description in claims. Also, additional advantages and modifications will readily occur to those skilled in the art. The invention in its broader terms is therefore not limited to the specific details, representative apparatus, and illustrative examples shown and described. For example, the applicable modifications are described below.

(1) In each of the above embodiments, the inlet-side passage 13*c* and the outlet-side passage 13*e* are provided to the cylinder 13. However, the configuration is not limited to the above. For example, the inlet-side passage 13*c* may be alternatively provided to the body 31 of the solenoid valve 30.

(2) In the second and third embodiments, the inferior angle formed between the center line J1 of the inlet-side passage 13*c* and the center line J2 of the outlet-side passage 13*e* is about 90 degree. However, the configuration is not limited to the above. For example, the inferior angle formed between the center line J1 of the inlet-side passage 13*c* and the center line J2 of the outlet-side passage 13*e* may be alternatively greater than 90 degree.

(3) In each of the above embodiments, the present invention is applied to a supply pump of a fuel injection apparatus for an internal combustion engine. However, the present invention is not limited to the above. For example, the present invention may be widely applicable to a pump that suctions and discharges fluid.

What is claimed is:

1. A pump comprising:

a cylinder having an inner peripheral surface, wherein the cylinder defines an outlet-side passage therein; and a plunger that is reciprocably received within the cylinder, wherein:

the plunger has an end surface;

the inner peripheral surface of the cylinder and the end surface of the plunger define a pump chamber;

the outlet-side passage of the cylinder is communicated with the pump chamber; and when the plunger reciprocates within the cylinder, fluid inside the pump chamber is pressurized such that fluid is discharged to an exterior of the pump through the outlet-side passage, wherein:

the inner peripheral surface of the cylinder includes a spherical surface part that surrounds the pump chamber;

the spherical surface part is defined by a curved surface having a predetermined curvature such that the pump chamber defines a spherical space;

the spherical surface part is provided with an opening of the outlet-side passage;

the opening of the outlet-side passage has a circular shape when observed from a spherical center of the pump chamber;

the inner peripheral surface of the cylinder includes a plunger receiving hole part, a side surface of the plunger sliding on the plunger receiving hole part;

the spherical surface part is formed such that the spherical space of the pump chamber has a spherical shape greater than a hemispherical shape; and the spherical space of the pump chamber has a diameter greater than a diameter of the plunger receiving hole part.

2. The pump according to claim 1, wherein:

the cylinder defines therein an inlet-side passage that is communicated with the pump chamber such that fluid is introduced into the pump chamber through the inlet-side passage;

the spherical surface part is provided with an opening of the inlet-side passage; and the opening of the inlet-side passage has a circular shape when observed from the spherical center of the pump chamber.

3. The pump according to claim 2, wherein:

the inlet-side passage is provided such that the spherical center of the pump chamber is positioned on an extension of a center line of the inlet-side passage; and the outlet-side passage is provided such that the spherical center of the pump chamber is positioned on an extension of a center line of the outlet-side passage.

4. The pump according to claim 3, wherein:

the inlet-side passage and the outlet-side passage are formed such that an inferior angle formed between the center line of the inlet-side passage and the center line of the outlet-side passage is equal to or greater than 90 degree.

5. The pump according to claim 1, wherein:

the plunger receiving hole part is integral with the spherical surface part.

6. The pump according to claim 1, wherein:

the end surface has a curved surface having a shape that corresponds to a shape of the spherical surface part that is opposed to the end surface.

7. A pump, comprising:

a cylinder having an inner peripheral surface, wherein the cylinder defines an outlet-side passage therein; and a plunger that is reciprocably received within the cylinder, wherein:

the plunger has an end surface;

the inner peripheral surface of the cylinder and the end surface of the plunger define a pump chamber;

the outlet-side passage of the cylinder is communicated with the pump chamber; and when the plunger reciprocates within the cylinder, fluid inside the pump chamber is pressurized such that fluid is discharged to an exterior of the pump through the outlet-side passage, wherein:

the inner peripheral surface of the cylinder includes a spherical surface part that surrounds the pump chamber;

the spherical surface part is defined by a curved surface having a predetermined curvature such that the pump chamber defines a spherical space;

the spherical surface part is provided with an opening of the outlet-side passage;

the opening of the outlet-side passage has a circular shape when observed from a spherical center of the pump chamber;

the cylinder defines therein an inlet-side passage that is communicated with the pump chamber such that fluid is introduced into the pump chamber through the inlet-side passage;

the spherical surface part is provided with an opening of the inlet-side passage;

the opening of the inlet-side passage has a circular shape when observed from the spherical center of the pump chamber;

the inlet-side passage is provided such that the spherical center of the pump chamber is positioned on an extension of a center line of the inlet-side passage;

the outlet-side passage is provided such that the spherical center of the pump chamber is positioned on an extension of a center line of the outlet-side passage; and the inlet-side passage and the outlet-side passage are formed such that an inferior angle formed between the center line of the inlet-side passage and the center line of the outlet-side passage is equal to or greater than 90 degrees.

8. The pump according to claim 7, wherein:

the spherical surface part is formed such that the spherical space of the pump chamber has a spherical shape equal to or more than a hemispherical shape.

9. The pump according to claim 7, wherein:

the inner peripheral surface of the cylinder includes a plunger receiving hole part, a side surface of the plunger sliding on the plunger receiving hole part; and the plunger receiving hole part is integral with the spherical surface part.

10. The pump according to claim 7, wherein:

the end surface has a curved surface having a shape that corresponds to a shape of the spherical surface part that is opposed to the end surface.

* * * * *